United States Patent [19]

Steuber

[11] 4,142,284

[45] Mar. 6, 1979

[54] MULTIPLE STORAGE TANK FABRICATION PROCEDURE

[75] Inventor: Charles P. Steuber, Pelham Manor, N.Y.

[73] Assignee: Anchortank, Inc., Seabrook, Tex.

[21] Appl. No.: 801,325

[22] Filed: May 27, 1977

[51] Int. Cl.[2] ..... B23P 17/00

[52] U.S. Cl. ..... 29/417; 29/429; 29/773; 52/747; 294/90

[58] Field of Search ..... 29/429, 773, 417; 294/90; 52/745, 747; 214/1 P, 3.1

[56] References Cited

U.S. PATENT DOCUMENTS

| | | | |
|---|---|---|---|
| 1,872,810 | 8/1932 | Raymond | 29/429 |
| 2,751,672 | 6/1956 | Reed | 29/429 |
| 2,831,720 | 4/1958 | Renfroe | 294/90 X |
| 3,239,927 | 3/1966 | Hozak | 29/429 |
| 3,263,321 | 8/1966 | Lombardi | 29/429 |

*Primary Examiner*—Charlie T. Moon

*Attorney, Agent, or Firm*—Cooper, Dunham, Clark, Griffin & Moran

[57] ABSTRACT

Method and apparatus for constructing a plurality of large diameter storage tanks of strip material. A continuous strip is fed to a support assembly at a single building site which supports the strip for production of a large diameter storage tank structure. The storage tank structure includes a plurality of helical convolutions extending upwardly, with the edge portions of adjacent convolutions secured together. The storage tank structure is severed along a horizontal plane above the support assembly. The portion of the severed tank structure above the severing plane is transported from the building site to a use site remote therefrom through use of a lifting collar removably positioned below the top of the transported tank structure. The above steps are continued to complete the production of one or more additional storage tanks.

3 Claims, 3 Drawing Figures

MULTIPLE STORAGE TANK FABRICATION PROCEDURE

BACKGROUND AND BRIEF DESCRIPTION OF THE INVENTION

This invention relates to the construction of large diameter storage tanks. It has particular application to the construction of a plurality of such tanks to be used in the building of a tank farm.

It has already been suggested in prior patents to build a large diameter storage tank by feeding a strip of steel to a support assembly for forming the steel into a plurality of helical convolutions that extend upwardly, with the edge portions of adjacent convolutions being secured together, such as by welding or riveting. Examples are given by the following patents:

| U.S. Pat. No. | Issue Date | Patentee |
|---|---|---|
| 2,751,672 | June 26, 1956 | D. J. Reed |
| 2,986,193 | May 30, 1961 | P. Howell |
| 3,380,147 | April 30, 1968 | E. O. McDonald |

In the building of such large diameter storage tanks it is conventional practice to build each tank at the site upon which the tank is to be located for ultimate use. This requires the moving of the apparatus for constructing the tank from use location to use location when a plurality of tanks are constructed. Such moving of the tank construction apparatus is cumbersome, time consuming, and expensive in terms of personnel and equipment involved.

The present invention is directed toward the production of a plurality of large diameter storage tanks. In practicing the invention, the tanks are all constructed at a single building site, and are transported from that site to the various use sites. To accomplish this end, strip material is supplied to a support assembly which is located at a single building site. That support assembly supports the strip for production of a large diameter storage tank structure that includes a plurality of helical convolutions extending upwardly. The edge portions of adjacent convolutions are secured together. The tank structure is severed along substantially a horizontal plane above the support assembly, and the portion of the severed tank structure that is located above the severing plane is transported from the building site to a use site remote therefrom. The severing of the tank structure in one cutting operation completes the bottom of one storage tank and the top of the next tank. Advantageously a top structure for the next tank to be built is joined to the top edge of the severed tank structure immediately following the severing operation. For tank transporting purposes, a lifting collar is advantageously used, removably positioned below the top structure of the storage tank. That lifting collar is coupled to the lifting cable of a crane which is used to transport the completed storage tank from the building site to the use site.

In the past, it has been conventional to sever spirally formed pipe into individual pipe sections. The following references are representative of this pipe construction technology:

| U.S. Pat. No. | Issue Date | Patentee |
|---|---|---|
| 1,906,011 | April 25, 1933 | C. G. Naylor |
| 3,183,695 | May 18, 1965 | F. M. Darner |

-continued

| U.S. Pat. No. | Issue Date | Patentee |
|---|---|---|
| 3,432,914 | March 18, 1969 | G. E. Huck |
| 3,677,046 | July 18, 1972 | H. E. Carroll |

The Naylor and Huck patents disclose the use of end pieces joined to the ends of individual pipe sections for coupling purposes in joining one section of pipe to another. The Huck patent, which provides for the shearing of the strip that is used to form the pipe (rather than cutting the completing pipe), specifically notes that the shearing of the strip to form one end of the pipe forms the beginning end of the strip for the next winding operation.

The technology directed to the production of individual pipe sections is not directly applicable to the building of large diameter storage tanks which are spiralled upwardly. Such storage tanks involve massive structures, and it has never been considered practical to build a storage tank at a location other than where it is to be used.

The use of a crane for lifting purposes in the building of tanks is disclosed in the following Patent:

| U.S. Pat. No. | Issue Date | Patentee |
|---|---|---|
| 3,239,927 | March 15, 1966 | R. F. Hozak |

In the Hozak patent cylindrical tank sections are successively joined one to the other, and a crane is used to lift the joined-together sections until the final completion of a storage tank. The crane, which is located at a single site, is then pivoted to another construction site. All the machinery used to form another tank is then removed to that new location and an additional storage tank is then built. This process continues until a plurality of storage tanks are built in a ring encircling the pivot point of the crane. The tank fabricating apparatus is thus not located at a single building site, and the use of this apparatus is limited to the building of storage tanks located in a single circular ring. In the present invention any number of storage tanks may be built at a single building site and located at any number of use sites.

The present invention is briefly alluded to in co-pending U.S. patent application Ser. No. 656,252 filed Feb. 9, 1976 for Storage Tank Construction Procedures in the name of Myron McFatter and assigned to the assignee of the present application. That McFatter application acknowledges the present invention.

The invention will be more completely understood by reference to the following detailed description.

DETAILED DESCRIPTION

Figure 1:
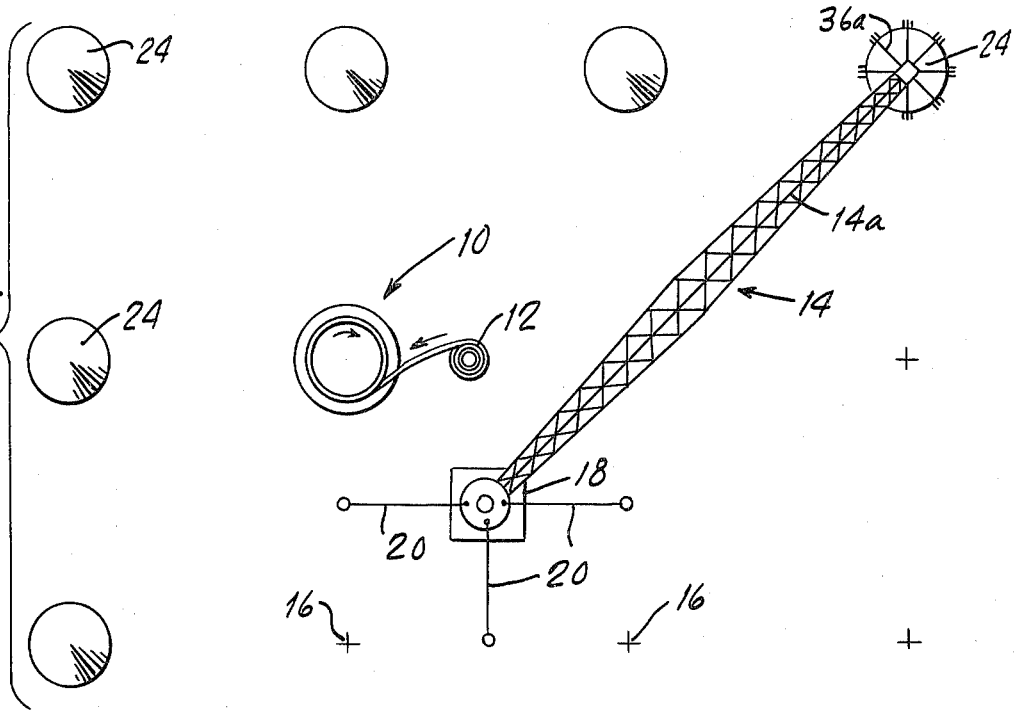
FIG. 1 is a plan view of apparatus for constructing a tank farm in accordance with the invention, shown schematically.

Referring to FIG. 1, a plurality of large diameter storage tanks are constructed at a building site 10. Each of the tanks is fabricated from a continuous strip of material, such as strip steel, supplied from a reel 12.

Each storage tank may be constructed in accordance with the procedures disclosed in the co-pending McFatter application, the entire disclosure of which is hereby incorporated by reference, as well as the McDonald and Reed patents, for example. Following the completion of the building of each storage tank at the site 10, that tank is severed from the strip, as described in more detail below, and moved through use of a crane 14 to any one of a number of use sites 16 within the same general area as the building site. The crane may be mounted upon a base pad 18 and guyed by support cables 20 in position.

Figure 2:
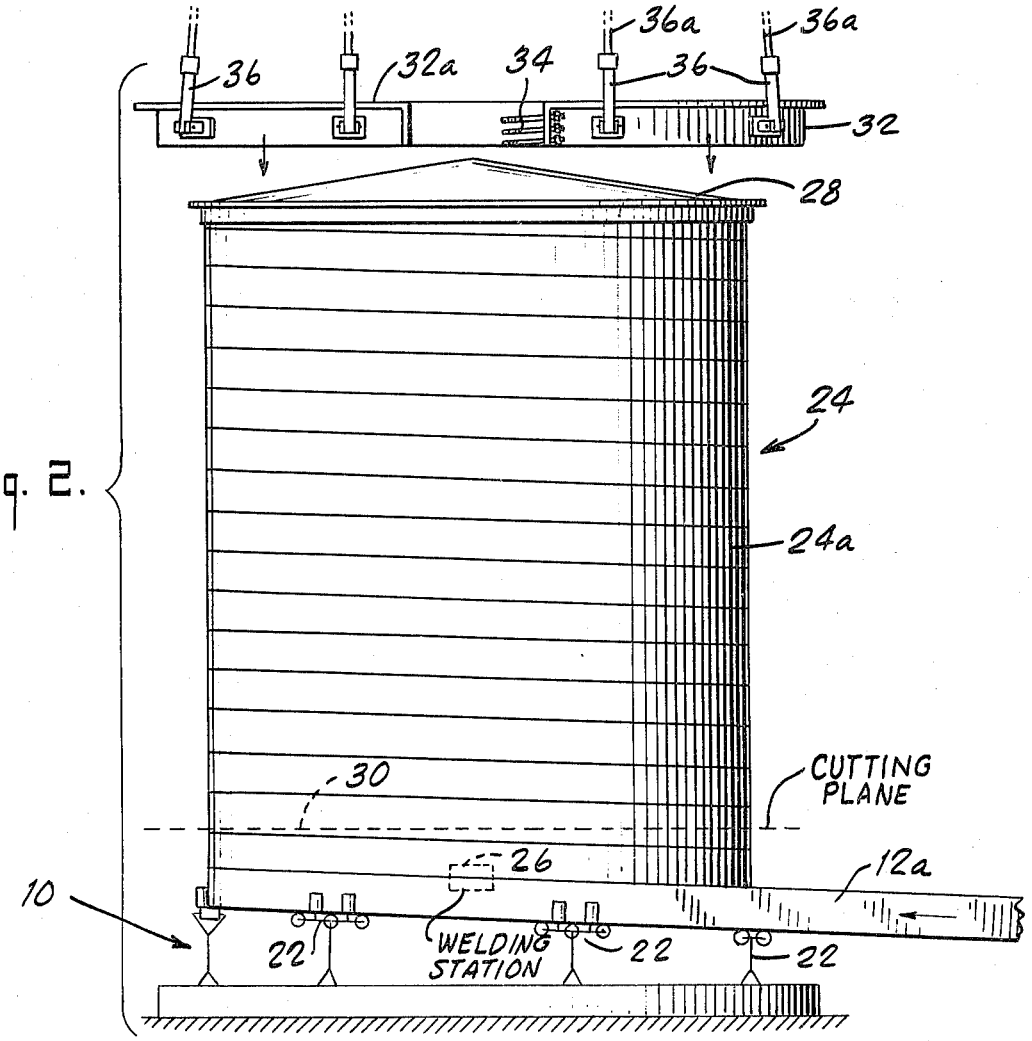
FIG. 2 is a side view of a storage tank structure illustrating the severing of that structure and a lifting collar.

Referring to FIG. 2, strip 12*a* of steel, for example, is supplied to the building site 10 and is supported by support roller assemblies 22 which may be of the type disclosed in the co-pending McFatter application. These support roller assemblies support the strip for production of a large diameter storage tank structure 24 that includes a plurality of helical convolutions 24*a* extending upwardly, with the edge portions of adjacent convolutions being secured together, such as by welding at a welding station 26. When a storage tank structure of sufficient size has been completed, that structure is severed along a severing plane 30 which is substantially horizontal and located above the support roller assemblies 22, such as by cutting of the storage tank. The storage tank advantageously includes a top structure 28 thereof, and a lifting collar 32 is employed to transport that portion of the storage tank structure located above the severing plane 30 from the building site 10 to one of the use sites 16.

Figure 3:
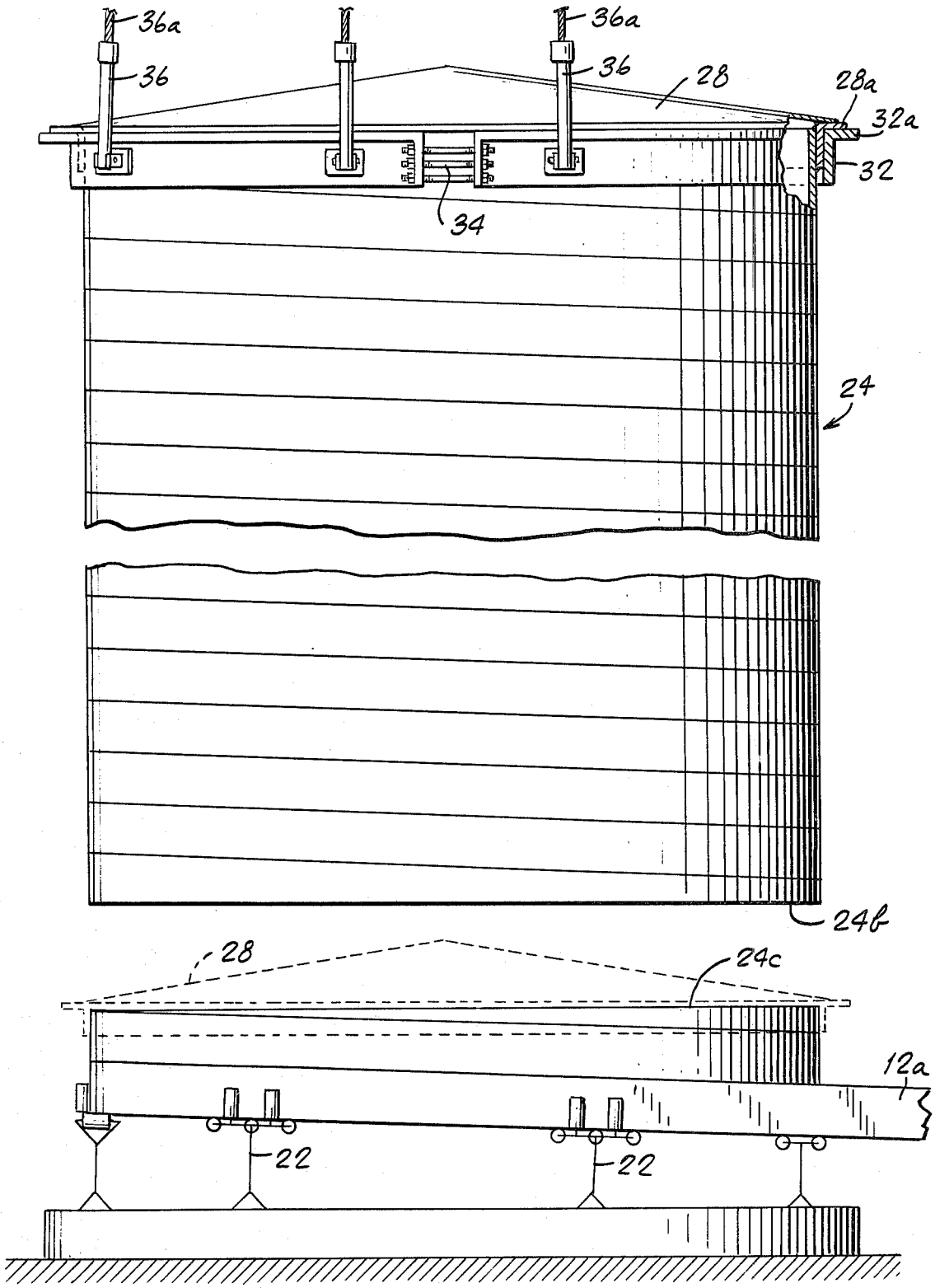
FIG. 3 is a view similar to FIG. 2, to an enlarged scale and illustrating more details.

The lifting collar 32 may take the form of an open-ended ring that includes a flanged upper portion 32*a*. The open ends of the ring may be closed by use of bolts 34. Rods 36 are pivotally attached to the collar 32 at spaced points along the collar. The rods 36 are connected by cables 36*a* to the lifting cable 14*a* of the crane 14 in FIG. 1. The lifting collar 32 is positioned about the storage tank 24 below the top structure 28, the open end of the ring is closed (as shown in FIG. 3), and the severed tank structure is lifted by use of the crane 14 and moved to a particular use site 16. From FIG. 3 it will be noted that the top structure 28 of the storage tank includes a flange 28*a*. The top flange 32*a* of the lifting collar engages the top structure flange 28*a* for the purpose of lifting the storage tank structure. After the storage tank structure has been transported to the use site, the bolts 34 are loosened, the lifting collar is removed from that storage tank, and the crane is pivoted to move another tank following its completion at the buildig site 10.

It will be noted that, when the storage tank structure is severed along the plane 30, the severing operation automatically completes the bottom edge 24*b* (FIG. 3) of one storage tank structure and the top edge 24*c* of the next tank to be built. Following the severing operation, the top structure 28 of the next tank may be secured in place, and that next tank completed by the feeding of strip 12*a* to the support roller assembly 22 and the securing together of adjacent convolutions of the strip, as described above.

The invention thus provides for the fabrication of storage tanks at a single building site, and their transportation from that site to various use sites. The dismantling of the apparatus for constructing the storage tanks is not required, along with the moving of that apparatus from one site to another, as is the present practice in the building of a plurality of storage tanks for use in a tank farm.

All though not specifically shown in the drawings, it should be noted that the completed storage tank as moved from the building site to the use site is placed upon a suitable and conventional base structure for permanent installation at the use site. Further, and as noted, the procedures described above are applicable to the construction of large diameter storage tanks. The typical size is 31 feet in diameter, with a circumference of about 98 feet. Sheet steel approximately ¼ inch thick and 4 feet in width may be employed. These sizes are representative and in no way limiting of the invention.

The present preferred embodiment of the invention disclosed herein is subject to modification by those skilled in the art. Accordingly, the invention should be taken to be defined by the following claims.

I claim:

1. The method of constructing a plurality of large diameter storage tanks of strip material comprising feeding a continuous strip to a support assembly at a single building site which supports the strip for production of a large diameter storage tank structure that includes a plurality of helical convolutions extending upwardly with the edge portions of adjacent convolutions being secured together, severing said tank structure along substantially a horizontal plane above the support assembly, transporting the portion of the severed tank structure that is above said plane from said building site to a use site remote therefrom but within the same general area as the building site for storage of materials at said use site, and continuing the aforementioned steps to complete the production of one or more additional storage tanks transported from said building site to various use sites within said same general area.

2. The method of constructing a plurality of large diameter storage tanks of strip material comprising feeding a continuous strip to a support assembly at a single building site which supports the strip for production of a large diameter storage tank structure that includes a plurality of helical convolutions extending upwardly with the edge portions of adjacent convolutions being secured together, severing said tank structure along substantially a horizontal plane above the support assembly, joining a top structure for the next tank to be built to the top edge of the severed tank structure that is below said plane, transporting the portion of the severed tank structure that is above said plane from said building site to a use site remote therefrom, and continuing the aforementioned steps to complete the production of one or more additional storage tanks.

3. A method according to claim 2, in which each of the severed structures which is transported is moved by lifting it through use of a lifting collar removably positioned below the top structure thereof.

* * * * *